US005333697A

United States Patent [19]

Frisbee et al.

[11] Patent Number: 5,333,697

[45] Date of Patent: Aug. 2, 1994

[54] FLIP BLOCK ASSEMBLY FOR CHANGING DOZER BLADE PITCH

[75] Inventors: Claude M. Frisbee, Schofield; Ronald H. Werner, Edgar, both of Wis.

[73] Assignee: Case Corporation, Racine, Wis.

[21] Appl. No.: 992,465

[22] Filed: Dec. 17, 1992

[51] Int. Cl.[5] ..... E02F 3/815

[52] U.S. Cl. ..... 172/821

[58] Field of Search ..... 172/277, 821, 816, 818, 172/824, 827, 801; 37/266, 271, 273

[56] References Cited

U.S. PATENT DOCUMENTS

| | | | |
|---|---|---|---|
| 3,991,832 | 11/1976 | Cooper | 172/821 X |
| 4,074,769 | 2/1978 | Frisbee | 172/804 |
| 4,270,617 | 6/1981 | Cantarella et al. | 172/821 |
| 4,570,367 | 2/1986 | Oya | 172/816 X |
| 4,638,869 | 1/1987 | Murphy et al. | 172/821 |
| 4,828,044 | 5/1989 | Horsch et al. | 172/821 |
| 4,828,045 | 5/1989 | Horsch et al. | 172/821 |
| 4,893,683 | 1/1990 | Horsch et al. | 172/821 |

OTHER PUBLICATIONS

Case Corporation Sheet 1150D Dozer Hydraulic Pitch Adjustment.

Photo Sheet—Deere & Co. Pitch Adjustment.

Caterpillar Co.—p. 48 Operation Section Machine Adjustments.

*Primary Examiner*—Clifford D. Crowder

*Assistant Examiner*—Ismael Izaguirre

*Attorney, Agent, or Firm*—Jansson & Shupe, Ltd.

[57] ABSTRACT

The invention is an in a dozer blade pitch adjustment assembly of the type having a blade pivot pin spaced from a reference line on a dozer blade assembly. The improvement comprises a flip block eccentrically mounted between lugs of the blade assembly for pivoting movement between a first position and a second position. Flipping the block to the first position or to the second position changes the spacing between the pivot pin and the reference line and the pitch of the blade is thereby changed. The block is retained in one position or the other by bolts extending through the lugs and into the block.

11 Claims, 4 Drawing Sheets

FLIP BLOCK ASSEMBLY FOR CHANGING DOZER BLADE PITCH

FIELD OF THE INVENTION

This invention relates generally to mobile machinery and, more particularly, to earth-moving machinery.

BACKGROUND OF THE INVENTION

The broad class of equipment known as mobile machinery includes machines known as dozers (sometimes called "bulldozers") which have a front-mounted blade for moving and removing earth as well as other materials atop or near the earth surfaces. Such dozers are sometimes mounted on rubber tires for propulsion. However, urging the dozer blade through the earth requires very high forward force and for that reason, crawler-mounted dozers are in wide use.

Such dozers are propelled by tracks (much like a military tank) and are capable of exerting high forward force on the blade. Such force is possible since the tracks bite into and engage the ground. Track-ground engagement is quite satisfactory for dozer operations and it is sometimes said the track and the ground are "geared" to one another like gear test are engaged.

Dozers remove earth in much the same way that a wood plane shaves wood, i.e., by passing a blade across the earth surface and "rolling up" a layer of earth. Such dozers are employed for road construction and to "shape" the exposed surface of the earth to some contour. They are also used to urge earth to one side or the other of the dozer's travel path rather than merely to push earth straight ahead.

The dozer operator is able to raise or lower the blade and to "skew" it left or right. It is this latter capability which permits earth to be urged to one side or the other. And the operator can also tilt the blade so that one end is higher than the other.

The operator is also able to orient the blade at a different "pitch" which means the blade can be rotated slightly about an axis extending across the blade. To put it another way, the orientation of the blade can be changed so that the blade "faces" upward more or less.

While adjustment of pitch is done relatively infrequently, the ability to do so is important at least for the following reasons. In hard earth or other material, the lower blade cutting edge can be positioned closer to vertical to better penetrate such material. On the other hand, when the blade is "laid back," the capacity of such blade to carry soft material is increased.

Manufacturers of dozers provide for blade pitch adjustment in a variety of ways. One way involves removing bolts at an attachment point near the lower rear of the blade and adding or removing shims to change blade pitch. Another way is by extending and retracting hydraulic cylinders to change such pitch. Yet another way involves a swinging link pivotably pinned at one end and having two apertures, either of which can accept a blade pin. Blade pitch is a function of which aperture is selected. It is understood that not all related parts are used in both blade pitch positions and this would present the risk of losing unused parts.

An arrangement involving hydraulic cylinders for pitch adjustment is shown in U.S. Pat. No. 4,074,769 (Frisbee). Yet other arrangements for changing blade pitch are shown in U.S. Pat. No. 4,893,683 (Horsch et al.), one of which includes a plate with several sets of bolt holes. Pitch is changed by removing the bolts, moving the plate until another set of its holes is aligned with the bolt holes and re-installing the bolts. Another arrangement shown in the Horsch et al. patent involves reversing the positions of two bearing plates which are of differing thicknesses.

While these arrangements have been generally satisfactory, some of them are attended by certain disadvantages. For example, in the arrangement involving the installation or removal of shims, the work must be performed near ground level and upon a mechanism which, more likely than not, is caked with dirt. And, of course, the arrangement assumes that the required shims will be readily available when needed—such assumption is not always correct.

While the use of hydraulic cylinders is very convenient for the operator, it is more costly to manufacture (and buy) in that the cylinders, hydraulic plumbing and pitch control valve are all required to be installed on the dozer. The swinging link arrangement is very difficult for one person to adjust at least in that it requires aligning a pin with a hole which may require dozer movement simultaneous with link-pin engagement. And special tools may be required to effect pitch change.

An improved assembly for changing dozer pitch which is simple and quick to use, which requires only common hand tools, which can be accomplished by one person working nominally at waist level and which makes full use of all related parts in either pitch position would be an important advance in the art.

OBJECTS OF THE INVENTION

It is an object of this invention to provide an improved assembly for changing dozer blade pitch which overcomes some of the problems and shortcoming of the prior art.

Another object of this invention to provide an improved assembly for changing dozer blade pitch which can be easily adjusted by one person.

Another object of this invention to provide an improved assembly for changing dozer blade pitch which requires only common hand tools in use.

Still another object of this invention to provide an improved assembly for changing dozer blade pitch which permits working well above ground level.

Yet another object of this invention to provide an improved assembly for changing dozer blade pitch which makes full use of all related parts, irrespective of blade pitch position. How these and other objects are accomplished will become more apparent from the following descriptions and the drawing.

SUMMARY OF THE INVENTION

The invention was developed in recognition of the fact that it is often desirable to change the "pitch" of a dozer blade to, e.g., penetrate hard earth or increase the carrying capacity of the blade, and of the fact that prior art mechanisms for doing so were sometimes less than satisfactory. The invention, aspects of which include a unique "flip block," is an improvement in a dozer blade pitch adjustment assembly of the type having a blade pivot pin spaced from a reference line on a dozer blade assembly.

The invention permits changing the pin-reference line spacing and comprises a flip block eccentrically-mounted to the blade assembly for pivoting movement between a first position and a second position. The pin-reference line spacing is changed by flipping the block to one position or the other.

The flip block includes a first edge spaced from the reference line by a first dimension and the first edge and the line define a first block portion. Similarly, the block has a second edge spaced from the reference line by a second dimension and the second edge and the line define a second block portion.

Measured parallel to the long axis of the dozer, these first and second portions have differing dimensions. Such portions are alternately interposed between the pin and the reference line, depending upon whether the flip block is in the first or second position.

More specifically, the flip block is generally rectangular and has a pivot axis generally coincident with the reference line. The flip block also has a pair of trunnions which are coincident with the pivot axis and on which the block pivots. The block edges are generally parallel to the pivot axis.

In a highly preferred arrangement, the dozer blade assembly includes a pair of spaced mounting lugs, each of which has an opening for receiving a trunnion. The flip block is eccentrically-mounted to the lugs in that each trunnion and the pivot axis extending therethrough are displaced slightly from the block center line so that the pivot axis is spaced somewhat farther from the first edge than from the second edge. Each mounting lug has first and second fastener holes, one on either side of the trunnion opening of that lug. The flip block includes an aperture receiving a fastener extending through the first or second fastener hole in a mounting lug to retain the block in the first or second position, respectively.

The improved assembly retains the dozer blade at either of two "pitch" positions while yet permitting the blade to be tilted left or right, i.e., rotated slightly about an axis generally parallel to the long axis of the dozer. The improved assembly includes a slider assembly which receives the pivot pin and which permits such pin to move laterally. The slider assembly is removably attached by bolts to the first edge or the second edge of the flip block when such block is in the first position or the second position, respectively.

Further details regarding the invention are set forth in the following detailed description taken in conjunction with the drawing.

DETAILED DESCRIPTION OF PREFERRED EMBODIMENTS

Figure 1:
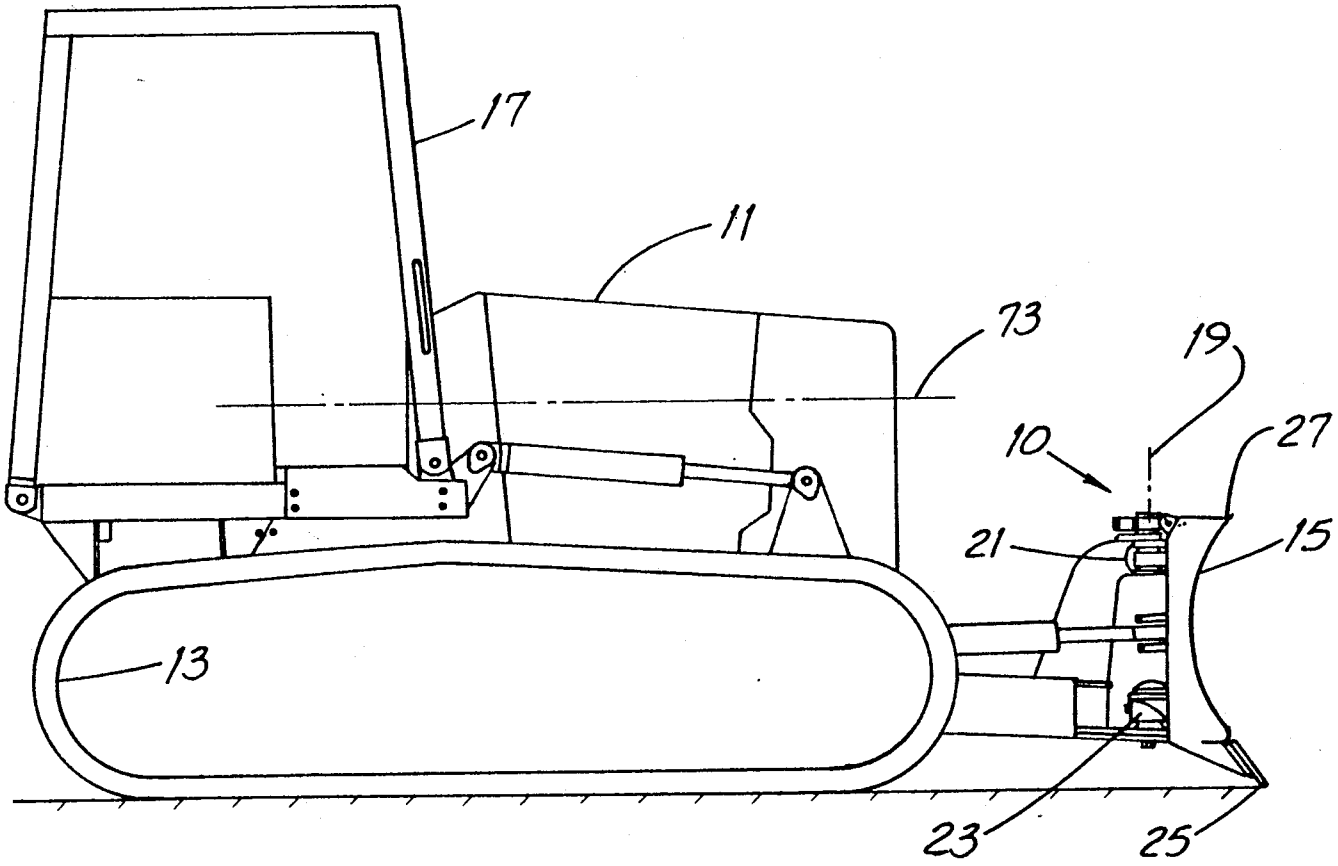
FIG. 1 is a side elevation view of a representative crawler-mounted dozer with adjustable pitch blade and incorporating the invention.

Referring first to FIG. 1, the inventive assembly 10 is shown in conjunction with a dozer 11 (sometimes referred to as a "bulldozer" which is mounted on crawler tracks 13 for propulsion and which is equipped with a dozer blade 15. From the seat in the cab 17, the operator can control the tilt, skew and raise/lower positions of the blade 15 to perform a particular task. When the blade 15 is angled left or right (or "skewed"), the blade 15 pivots about an axis 19 extending through the top and bottom pivot mounts 21 and 23, respectively.

From the perspective of FIG. 1, it is easier to envision why the blade cutting edge 25 better penetrates hard material "chisel-like" if such edge 25 is oriented more vertically. It is also easier to envision how the blade 15 can carry more material if its top edge 27 is pitched to the rear so that the blade 15 "faces" upward somewhat.

Figure 2:
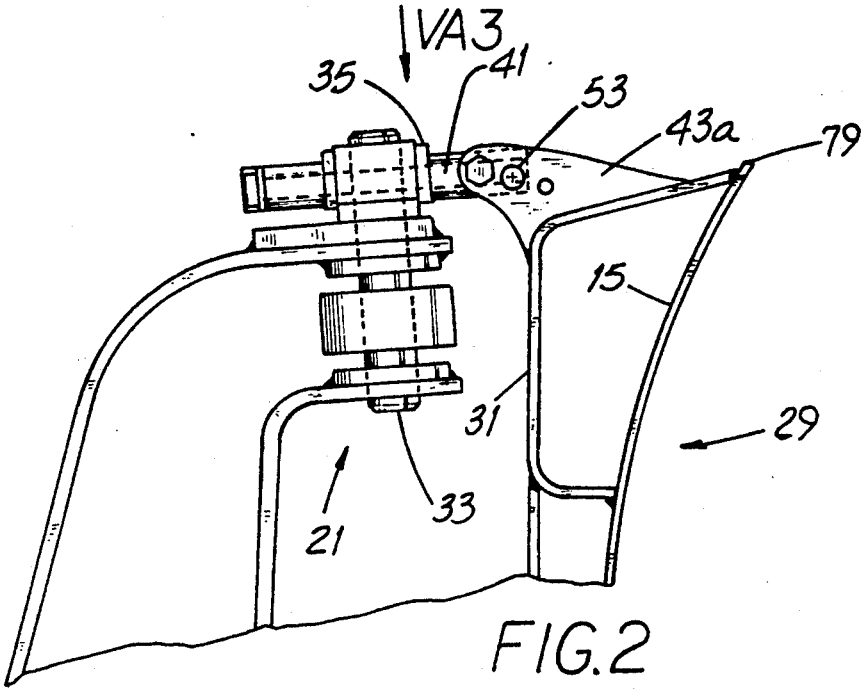
FIG. 2 is a side elevation view of the dozer blade and blade support frame shown in FIG. 1 and incorporating the inventive assembly. The assembly is set such that the upper edge of the blade is in the forward position. Parts are broken away and other parts are shown in dashed outline.
Figure 3:
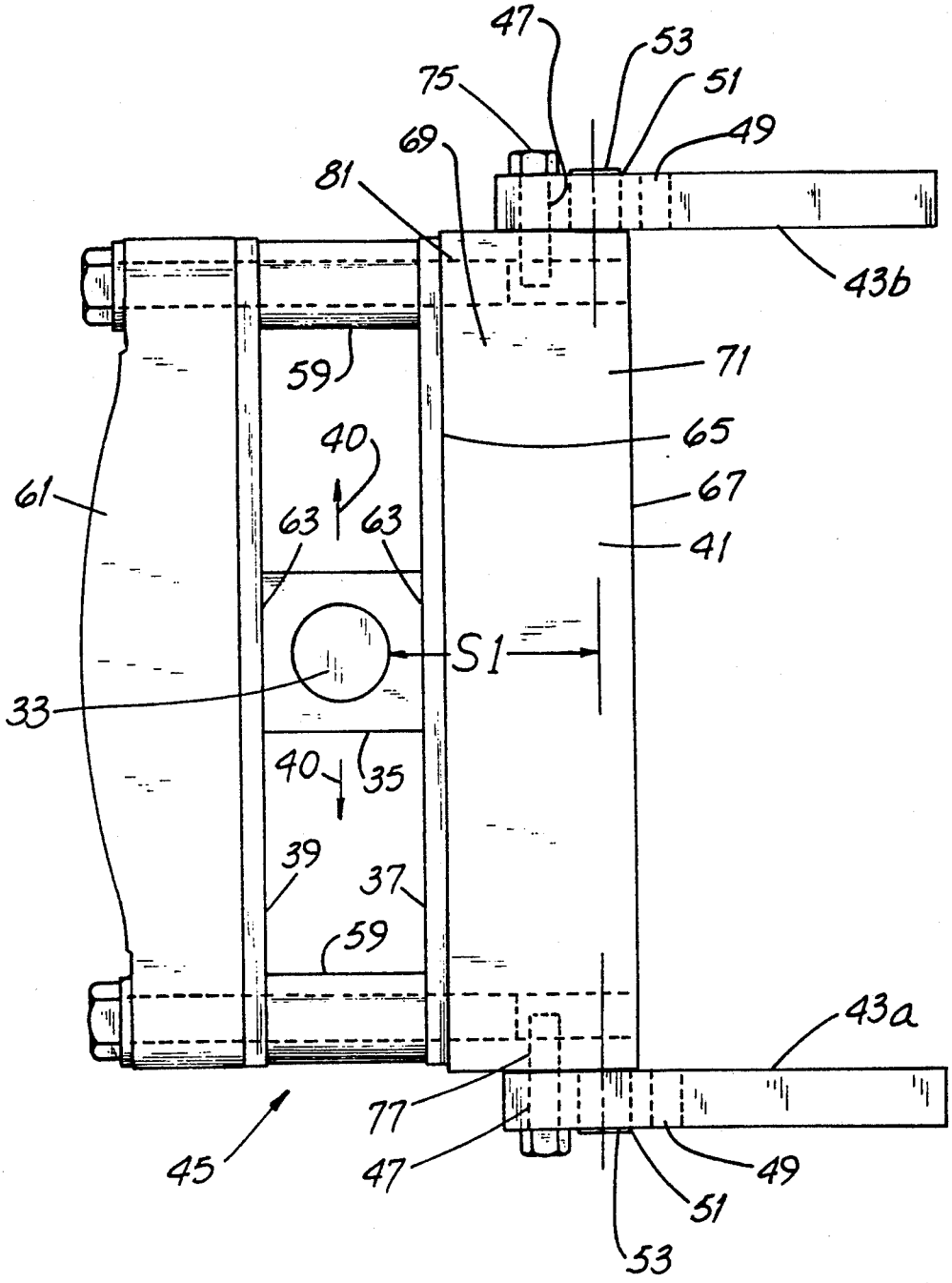
FIG. 3 is a top plan view of the assembly shown in FIG. 2 taken along the viewing axis VA3 thereof. The assembly is set such that the upper edge of the blade is in the forward position. Parts are broken away and other parts are shown in dashed outline.

Referring also to FIGS. 2 and 3, the dozer blade assembly 29 includes the cutting edge 25 and the blade 15 which is reinforced by bracing members 31. The assembly 29 is supported on the dozer 11 by a pair of pivot mounts 21 and 23, respectively, the lower mount 23 being of the universal type to permit blade movement in three axes, i.e., tilt, skew and pitch. The upper mount 21, other details of which are described following, has a pin 33 and sliding block 35 permitting, respectively, skewing the blade 15 about the pin 33 and/or tilting the blade 15 so that one end is lower than the other. When the blade 15 is only skewed, blade motion is only pivoting about the pin 33. When the blade 15 is only tilted, the pin 33 and the slider block 35 slide laterally (up and down in the view of FIGS. 3 and 5) between the guide plates 37, 39 as represented by the arrows 40. As an example, when the left end of the blade 15 (as viewed by the operator) is lowered with respect to the right end, the pin 33 and slider block 35 slide upward. When blade skewing and tilting occur simultaneously, both types of motion also occur simultaneously. Further details of the blade assembly 29 will now be set forth and such description is followed by a detailed description of the flip block.

The blade assembly 29 also includes a pair of rearward-extending, spaced, generally parallel mounting lugs **43*a*, 43*b* which are permanently attached to a bracing member 31. Such lugs 43*a*, 43*b* are also connected, by means of an eccentrically-mounted flip block 41, to a slider assembly 45 in the manner described below. Each lug 43*a*, 43*b* has a first hole 47 and a second hole 49 which are in general registry with the corresponding holes 47, 49 of the other lug 43. Between the holes 47, 49 of each lug is an opening 51 receiving a trunnion 53 of the flip block 41 and the openings 51 (as well as the trunnions 53 received therein) define a reference line 55*a* which in the illustrated preferred embodiment is coincident with the block pivot axis 55*b***.

A slider assembly 45 is attached to the flip block 41 by a pair of bolts 57 and includes a pair of spaced, laterally extending guide plates 37 and 39, a pair of end spacers 59 for maintaining plate spacing and a backing bar 61 reinforcing the rear guide plate 39. The slider assembly 45 also includes the slider block 35, the opposed sides 63 of which are spaced apart by a dimension permitting lateral, sliding movement of the block 35 between the plates 37, 39.

The trunnion-mounted, pivotable flip block 41 is generally rectangular and has a first edge 65 and a second edge 67 generally parallel to one another and to the reference line 55*a*. The first edge 65 and the reference line 55*a* define a first block portion 69 while the second edge 67 and the reference line 55*a* define a second block portion 71. The portions 69, 71 have differing dimensions as measured width-wise (left/right in the views of FIGS. 3 and 5) and it should be appreciated that as used herein, the width of the block 41 (or of a block portion 69 or 71) is measured in a direction generally corresponding to the long axis 73 of the dozer 11.

A fastener 75, e.g., a bolt, extends through a hole 47 or 49 in each lug and engages a hole 77 in the flip block 41. When the block 41 is in a selected position, the fastener 75 retains the block 41 at such position.

In operation and considering FIGS. 2 and 3, it is assumed that the flip block 41 is in its first position as shown. When so positioned, the first portion 69 is interposed between the pin 33 and the reference line 55*a* and the first edge 65 abuts the forward guide plate 37 of the slider assembly 45. When the flip block 41 is in the first position, the top edge 79 of the blade 15 is at what is defined as a forward position. That is, the blade 15 is pitched more forward so that the cutting edge 25 is more nearly vertical.

It is next assumed that the operator wishes to pitch the blade 15 more to the rear. To do so, the fasteners 75 are withdrawn from the first holes 47 of the lugs 43*a*, 43*b* to "clear" the end of the flip block 41. The bolts 57 are also withdrawn from their holes 81 in the flip block 41. It is apparent that when the bolts 57 and 75 are so withdrawn, the flip block 41 is free to be "flipped," i.e., rotated 180° about the pivot axis 55*b*.

Figure 4:
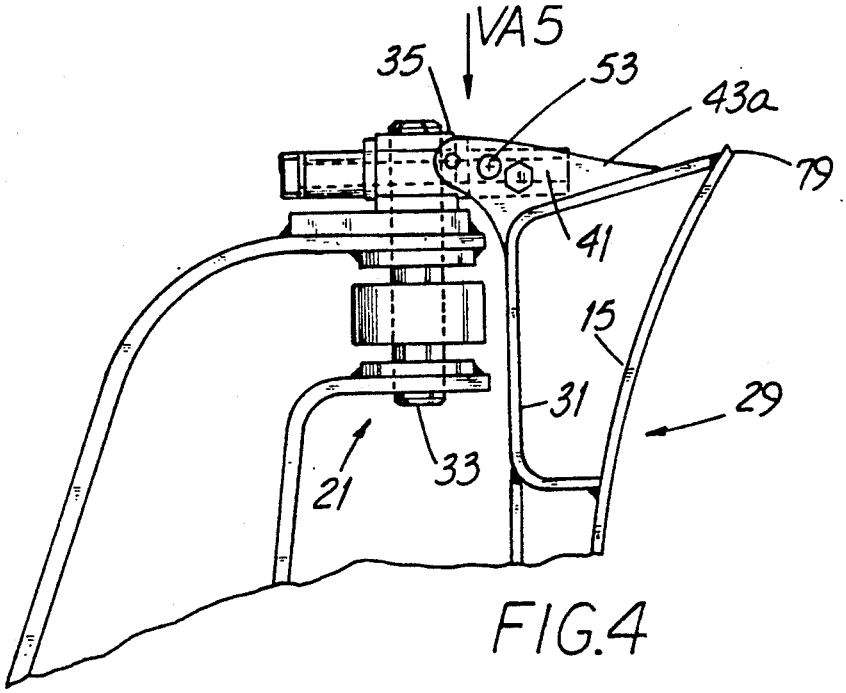
FIG. 4 is a side elevation view of the dozer blade and blade support frame similar to that of FIG. 2 but with the inventive assembly set such that the upper edge of the blade is in the rear position. Parts are broken away and other parts are shown in dashed outline.
Figure 5:
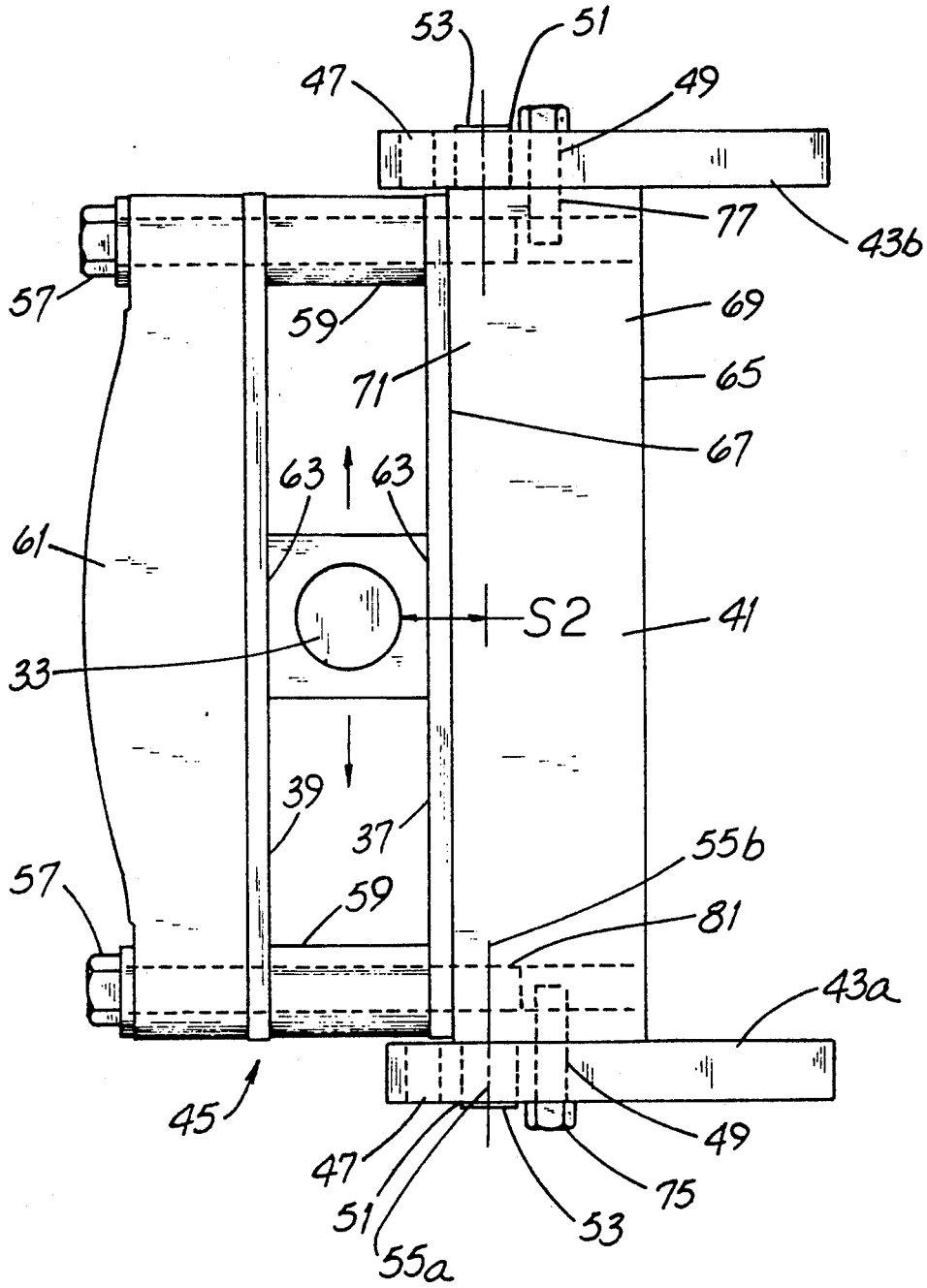
FIG. 5 is a top plan view of the assembly shown in FIG. 4 taken along the viewing axis VA5 thereof. The assembly is set such that the upper edge of the blade is in the rear position. Parts are broken away and other parts are shown in dashed outline.

Referring also FIGS. 4 and 5, the flip block 41 is rotated to the position shown in FIG. 5 wherein its first edge 65 now faces the blade 15, its second edge 67 now abuts the forward guide plate 37 of the slider assembly 45 and its second portion 71 is interposed between the pin 33 and the reference line 55*a*. The bolts 57 are then re-inserted and tightened and the fasteners 75 are inserted through their respective second holes 49 in the lugs 43 into engagement with the respective ends of the block 41.

From FIGS. 3 and 5, it will be apparent that when the flip block 41 is in its first position (FIG. 3), the space S1 between the pin 33 and the reference line 55*a* (and therefore, between the pin 33 and the lugs 43) is greater than the space S2 (FIG. 5) when the flip block 41 is in its second position. Since the pivot pin 33 does not exhibit translational movement with respect to the dozer frame (but, rather, only pivoting movement), such pin 33 may be considered as something of a reference point. Therefore, when the block 41 is in its first position, the lugs 43 are farther from the pin/reference point, i.e., more to the right as shown in FIG. 2, and the blade 15 is pitched more forward. Similarly, when the block 41 is in its second position, the lugs 43 are closer to the pin 33, i.e., more to the left as shown in FIG. 4, and the blade 15 is pitched more to the rear.

While the principles of the invention have been described in connection with only a single embodiment, it should be understood clearly that such description and embodiment are exemplary and not intended to be limiting.

We claim:

1. In a dozer blade pitch adjustment assembly having a blade pivot pin spaced from a reference line on a dozer blade assembly, the improvement comprising:

a single flip block mounted to the blade assembly for pivoting movement about a pivot axis, such movement being between a first position and a second position, and wherein:

the spacing maintained between the pivot pin and the reference line is changed by pivoting the block from one position to the other position.

2. The adjustment assembly of claim 1 wherein the flip block includes:

a first edge spaced from the reference line by a first dimension; and, a second edge spaced from the reference line by a second dimension.

3. The adjustment assembly of claim 2 wherein the flip block has a pivot axis coincident with the reference line and the edges are parallel thereto.

4. The adjustment assembly of claim 2 including a slider assembly receiving the pivot pin and wherein:

the slider assembly is attached to the first edge or the second edge when the flip block is in the first position or the second position, respectively.

5. The adjustment assembly of claim 1 wherein the dozer blade assembly includes a pair of spaced mounting lugs and the flip block is eccentrically-mounted to the lugs.

6. The adjustment assembly of claim 5 wherein the flip block includes an aperture receiving a fastener extending through a mounting lug, whereby the block is retained in the first position or the second position.

7. The adjustment assembly of claim 6 wherein:

the mounting lug includes first and second holes; and, the fastener extends through the first hole or the second hole when the flip block is in the first position or the second position, respectively.

8. The adjustment assembly of claim 1 wherein the flip block includes:

a first portion interposed between the pin and the reference line when the block is in the first position;

a second portion interposed between the pin and the reference line when the block is in the second position; and, the portions have differing dimensions.

9. The adjustment assembly of claim 8 wherein:

the first portion is defined by a first edge and the reference line;

the second portion is defined by a second edge and the reference line;

the flip block is generally rectangular and has a pivot axis generally coincident with the reference line;

the flip block includes a pair of trunnions coincident with the pivot axis.

the dozer blade assembly includes a pair of spaced mounting lugs; and, each trunnion engages a separate mounting lug.

10. In a dozer blade pitch adjustment assembly having a blade pivot pin spaced from a reference line on a dozer blade assembly, the improvement comprising:

a pair of spaced mounting lugs;

a flip block eccentrically-mounted to the lugs for pivoting movement between a first position and a second position, whereby the spacing between the pivot pin and the reference line may be changed by rotating the block to the first position or the second position.

11. In a dozer blade pitch adjustment assembly having a blade pivot pin spaced from a reference line on a dozer blade assembly, the improvement comprising:

a pair of spaced mounting lugs;

a generally rectangular flip block mounted for pivoting movement between a first position and a second position; and wherein the flip block includes:

a pair of trunnions defining a pivot axis generally coincident with the reference line, each trunnion engaging a separate mounting lug;

a first edge and a second edge;

a first portion defined by the first edge and the reference line;

a second portion defined by the second edge and the reference line;

and wherein:

the first portion is interposed between the pin and the reference line when the block is in the first position;

the second portion is interposed between the pin and the reference line when the block is in the second position; and the portions have differing dimensions.

* * * * *

UNITED STATES PATENT AND TRADEMARK OFFICE

CERTIFICATE OF CORRECTION

PATENT NO. : 5,333,697

DATED : August 2, 1994

INVENTOR(S) : Claude M. Frisbee and Ronald H. Werner

It is certified that error appears in the above-indentified patent and that said Letters Patent is hereby corrected as shown below:

In the abstract, line 1, after "an", insert --improvement--.

In column 4, line 11, after "bulldozer", insert a --)--.

In column 6,

Claim 1 should read as follows:

--1. In a dozer blade pitch adjustment assembly having a blade pivot pin spaced from a reference line on a dozer blade assembly, the improvement comprising:

-a single flip block mounted to the blade assembly by a trunnion for pivoting movement about a generally horizontal trunnion pivot axis, such movement being between a first position and a second position, and wherein:

-the spacing maintained between the trunnion pivot axis and the reference line is changed by pivoting the block about the trunnion pivot axis from one position to the other position.--

UNITED STATES PATENT AND TRADEMARK OFFICE

CERTIFICATE OF CORRECTION

PATENT NO. : 5,333,697

DATED : August 2, 1994

INVENTOR(S) : Claude M. Frisbee and Ronald H. Werner

It is certified that error appears in the above-indentified patent and that said Letters Patent is hereby corrected as shown below:

Column 6, claim 10, line 8, delete "may be" and insert --is--.

Signed and Sealed this

Twenty-fifth Day of October, 1994

*Attest:*

Bruce Lehman

BRUCE LEHMAN

*Attesting Officer*

*Commissioner of Patents and Trademarks*